US007048270B2

(12) United States Patent
Herkel et al.

(10) Patent No.: US 7,048,270 B2
(45) Date of Patent: May 23, 2006

(54) METHOD FOR DECKLE ADJUSTMENT IN A PACKAGING MACHINE AND LEAFLET SUPPLY DEVICE

(75) Inventors: Wolfgang Herkel, Muggensturm (DE); Bernd Hähnel, Stutensee (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 22 days.

(21) Appl. No.: 10/485,641

(22) PCT Filed: Sep. 27, 2002

(86) PCT No.: PCT/EP02/10875

§ 371 (c)(1),
(2), (4) Date: Feb. 3, 2004

(87) PCT Pub. No.: WO03/029082

PCT Pub. Date: Apr. 10, 2003

(65) Prior Publication Data

US 2004/0206053 A1 Oct. 21, 2004

(30) Foreign Application Priority Data

Sep. 28, 2001 (DE) ..... 101 48 249

(51) Int. Cl.
*B65B 61/20* (2006.01)

(52) U.S. Cl. ..... 270/58.02; 493/416; 493/436; 198/419.2

(58) Field of Classification Search ..... 270/58.02; 493/416, 436; 198/419.2
See application file for complete search history.

(56) References Cited

U.S. PATENT DOCUMENTS

| | | | | |
|---|---|---|---|---|
| 1,890,971 | A * | 12/1932 | Cundall | 493/416 |
| 4,059,264 | A * | 11/1977 | Vogel | 271/270 |
| 4,690,269 | A * | 9/1987 | Takao | 198/419.2 |
| 4,747,817 | A * | 5/1988 | Newsome | 493/438 |
| 5,326,087 | A * | 7/1994 | Colson et al. | 270/58.02 |
| 5,511,769 | A * | 4/1996 | Wamsley et al. | 270/58.26 |
| 6,746,007 | B1 * | 6/2004 | DaCunha et al. | 270/58.02 |

FOREIGN PATENT DOCUMENTS

| | | |
|---|---|---|
| DE | 198 10 112 | 9/1999 |
| DE | 198 22 837 | 10/1999 |
| DE | 198 41 526 | 3/2000 |
| DE | 199 20 255 | 11/2000 |
| DE | 699 00 225 | 12/2001 |
| EP | 0 806 363 | 11/1997 |
| EP | 1 050 472 | 11/2000 |

* cited by examiner

*Primary Examiner*—Patrick Mackey
(74) *Attorney, Agent, or Firm*—Paul Vincent

(57) ABSTRACT

The invention relates to a method for format adjustment in a packaging machine whereby a leaflet (P), folded in a folding device (16), is supplied to a leaflet transport (11) at a constant speed (V1) using a leaflet supply device (20). The transport moves at a constant speed (V2) and the leaflet is transferred to a holder (12) on the leaflet transport and supplied, in the holder, to a folded-box transport (14). The transfer position for the leaflet in the holder of the leaflet transport is adjustable for a format adjustment of the leaflet. Separate drives are provided for the leaflet supply device and the leaflet transport.

10 Claims, 5 Drawing Sheets

METHOD FOR DECKLE ADJUSTMENT IN A PACKAGING MACHINE AND LEAFLET SUPPLY DEVICE

BACKGROUND OF THE INVENTION

This application is the national stage of PCT/EP02/10875 filed on Sep. 27, 2002 and also claims Paris Convention priority of DE 101 48 249.3 filed Sep. 28, 2001.

The invention concerns a method for changing the format in a packaging machine, wherein a leaflet folded in a folding apparatus is supplied at a constant speed $V_1$ via a leaflet supply device to a leaflet transport device which is moved at a constant speed $V_2$, wherein the leaflet is received in a holder of the leaflet transport device and supplied in the holder to a folding box transport device, wherein the position of transfer of the leaflet to the holder of the leaflet supply device can be adjusted when the format of the leaflet changes.

The invention also concerns a transfer device in a packaging machine, in particular for carrying out the method, comprising a leaflet supply device for supplying a leaflet, folded in a folding apparatus, with a constant speed $V_1$ to a leaflet transport device which is moved at a constant speed $V_2$ and has at least one holder for receiving the leaflet, wherein the leaflet in the holder can be supplied to a folding box transport device and be inserted into a folding box transported therein, and wherein the position of transfer of the leaflet to the holder of the leaflet transport device can be adjusted when the format of the leaflet changes.

A packaging machine for inserting a product into a folding box is usually referred to as a cartoning machine. Such a cartoning machine has a product transport device, in particular in the form of a circulating chain, which has a plurality of compartments with one product each. A folding box transport device travels parallel to the product supply device, and also has a plurality of compartments with one folding box each which is open on the side. The product supply device and folding box transport device travel, at least in sections, parallel to each other at the same speed such that a product can be inserted laterally by the product supply device into the folding box located on the folding box transport device.

For certain products, one must or would like to also insert a leaflet into the folding box containing e.g. information about the product. This is generally realized in that the leaflet is disposed between the product and the folding box such that the product carries along the leaflet and inserts it into the folding box when introduced into the folding box.

The leaflets are conventionally provided in an unfolded state on a pile and supplied individually from this pile to a folding device, in which the leaflet is folded in the desired manner. The folded leaflet is then received by a leaflet supply device at the output of the folding apparatus, with which it is supplied at a constant speed $V_1$ to a leaflet transport device during the packaging operation of the packaging machine. The leaflet transport device moves at a speed $V_2$ which is constant during the packaging operation of the packaging machine and carries a plurality of tong-like holders. The folded leaflet is transferred to a holder of the leaflet supply device by the leaflet supply device at a predetermined transfer position and is introduced between the product and the folding box. During the packaging operation, the leaflet supply device and the leaflet transport device operate with a constant speed ratio $V_1/V_2$, wherein the speed $V_1$ of the leaflet supply device is approximately 2 to 3.5 times the speed $V_2$ of the leaflet transport device.

To reliably ensure that the leaflets are inserted into the folding box, one must ensure that the leaflets are properly transferred by the leaflet supply device to the leaflet transport device i.e. at a predetermined time and at the predetermined transfer position. Towards this end, the transferred leaflet is positioned in the leaflet supply device with high accuracy relative to the tong-like holder of the leaflet transport device which is to receive the leaflet. In particular, during format change i.e. when the packaging machine is changed for products with different dimensions, time-consuming and expensive adjustment is required to adjust the transfer position of the leaflet to the holder of the leaflet transport device and to adjust to the new leaflet format.

In a conventional cartoning machine, the drive motions of the folding apparatus, the leaflet supply device and the leaflet transport device are effected via a common drive shaft, the so-called main drive, using suitable transmissions. However, the time required for folding the leaflets in the folding apparatus depends on the size of the leaflets. Such time differences for leaflets of different sizes are usually compensated for by decelerating or delaying the leaflets during supply by the leaflet supply device to the holder of the leaflet transport device in a suitable fashion or by using different transmissions for the drive motion for the leaflet supply device in dependence on the size of the leaflet to be folded. Both approaches are very demanding and require many adjustment processes to achieve transfer of the leaflet to the holder in a predetermined orientation and to dispose it between the product and the folding box.

It is the underlying purpose of the invention to present a method for format change in a packaging machine which reliably obtains exact positioning of the leaflet relative to the receiving holder even during format change in a simple fashion and also to present a leaflet transfer device for carrying out the method with high precision.

SUMMARY OF THE INVENTION

This object is archived with the method in accordance with the independent claims.

In accordance with the invention, the leaflet supply device and the leaflet transport device are driven by their own drive devices, independently of each other, thereby permitting change of the relative positions between a leaflet located in the leaflet supply device and the associated holder of the leaflet transport device only through control of the corresponding drive device without having to constrain the supply motion or change the transmission.

To ensure failure-free supply of the folded leaflet to the product and the folding box, the leaflet must be positioned with high accuracy relative to the holder at the point of transfer from the leaflet supply device to the holder of the leaflet transport device. This is ensured in accordance with the invention during format adjustment in that the position of the folded leaflet in the leaflet supply device is detected by a leaflet sensor which transmits a corresponding leaflet position signal to a control device. The position of that holder of the leaflet transport device which is to receive the leaflet is detected by a holder sensor. The holder sensor transmits a corresponding holder position signal to the control device. The control device can determine the current actual relative position between the leaflet and the holder from the leaflet position signal and the holder position signal, and compare it with a desired relative position. When the deviation between the actual relative position and the desired relative position is below a predetermined limit value, i.e. sufficiently small that proper transfer of the leaflet can be expected despite the deviation, no adjustment of the positioning is required. The deviation occurring when the format is changed and leaflets of different sizes must be processed, is generally sufficiently large that the relative position between the leaflet and the holder must be adjusted. This is effected through the control device which adjusts the position of the leaflet in the leaflet supply device through control of the drive device of the leaflet supply device such that the deviation between the actual relative position and the desired relative position is below the predetermined limit value.

The mentioned settings must be effected only once during format change. Once the relative positions are set, they are maintained for subsequent leaflets and corresponding holders. During the subsequent packaging operation, the leaflet supply device and the leaflet transport device are again moved with a constant speed ratio (or each at a constant speed) based on the newly set, relative position.

During format change, the size of the folding box and/or product may also be changed. A corresponding change may require adjustment of the leaflet transport device, i.e. of the position of the holder bearing the leaflet, relative to the folding box transport device, i.e. the folding box, to ensure proper insertion of the leaflet into the folding box. Towards this end, an operator conventionally releases a coupling between the folding box supply device and the leaflet transport device which are preferably both driven via the main drive, and manually adjusts the leaflet transport device relative to the folding box transport device in a desired fashion and subsequently recouples the folding box transport device and the leaflet transport device. In a further development of the invention, the adjustment of the leaflet transport device is detected by a sensor and, in particular, by a holder sensor. A corresponding adjustment signal is provided to the control device and the control device also adjusts the position of the leaflet in the leaflet supply device until the deviation between the actual relative position and the desired relative position between the leaflet and the holder is again below the predetermined limit value. In this fashion, adjustment of the leaflet transport device relative to the folding box transport device which requires adjustment of the leaflet transport device relative to the leaflet supply device, is compensated for.

The above-mentioned object is achieved in view of the device in that the leaflet supply device and the leaflet transport device can be driven independently of each other, wherein the leaflet supply device has a leaflet sensor for detecting the position of the folded leaflet in the leaflet supply device, the leaflet transport device having a holder sensor for detecting the position of the holder receiving the leaflet, and a control device receives a leaflet position signal from the leaflet sensor and a holder position signal from the holder sensor, and can determine an actual relative position between the leaflet and the holder and compare it with a desired relative position, wherein the position of the leaflet in the leaflet supply device and/or the position of the holder in the leaflet transport device can be adjusted by the control device.

The leaflet supply device and the folding apparatus preferably have a common drive device which can be embodied, in particular, by a servo motor.

In a further development of the invention, an adjustment device may be provided for adjusting the leaflet transport device relative to the folding box transport device, wherein the adjustment of the leaflet transport device can be detected by a sensor and a corresponding adjustment signal can be issued to the control device. The control device determines a corresponding correction amount and adjusts the leaflet supply device such that the predetermined relative position between the holder of the leaflet transport device and a predetermined location in the leaflet supply device corresponds again to a leaflet located at a predetermined desired relative position or is at least below the limit value.

Additional features of the inventive leaflet transfer device can be extracted from the above description of the inventive method.

Further details and features of the invention can be extracted from the following description of an embodiment with reference to the drawing.

DESCRIPTION OF THE PREFERRED EMBODIMENT

Figure 1:
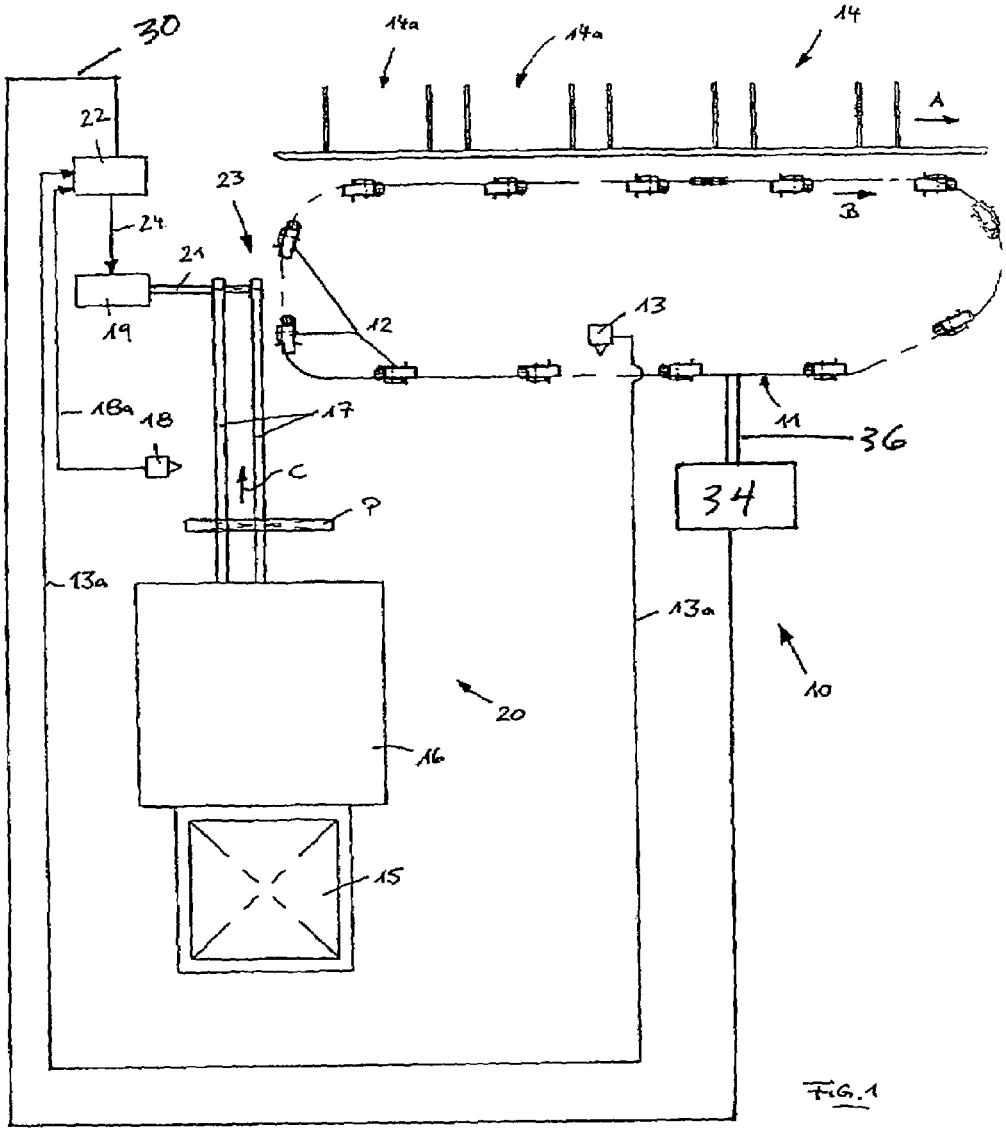
FIG. 1 shows a schematic representation of the essential components of a leaflet transfer device before adjustment of the desired relative position.

In accordance with the figures, a packaging machine 10 comprises a folding box transport device 14 of conventional structure which is formed as an endless circulating band or chain and has a plurality of compartments 14*a* for receiving one folding box each. The folding box transport device 14 is driven in the direction of arrow A.

The folding box transport device 14 is associated, in sections, with a leaflet transport device 11 which is also formed as circulating chain and which has a plurality of tong-like holders 12. Sections of the leaflet transport device 11 are oriented such that they are driven parallel to the folding box transport device 14 and at the same speed, as indicated by arrow B. The holders 12 are disposed at equal separations on the circulating leaflet transport device 11 and receive one leaflet each.

The leaflets are initially located in a leaflet pile 15, disposed flatly, one on top of the other. They are drawn from the leaflet pile 15 into a folding apparatus 16 of conventional structure and are folded therein in the desired fashion. The folding apparatus 16 is part of a leaflet supply device 20 for supplying the folded leaflets P at a constant speed $V_1$ to the leaflet transport device 11 to be received by its tong-like holders 12. Towards this end, two parallel delivery bands 17 extend between the folding apparatus 16 and a transfer region 23 on which the leaflet P is transported. The delivery bands 17 and the folding apparatus 16 are driven by a common drive device 19 in the form of a servo motor, wherein the drive motion of the drive device 19 is transferred via a transfer element 21 to the delivery bands 17 and via same, also to the folding apparatus 16.

A leaflet sensor 18 is disposed next to the delivery bands 17 and is connected to a control device 22 via a line 18*a*. The leaflet sensor 18 which may be a light barrier or similar device, detects when the leaflet P is disposed directly next to the leaflet sensor 18 and can transmit a corresponding leaflet position signal to the control device 22.

The leaflet transport device 11, which is moved at a constant speed $V_2$, has an associated holder sensor 13 which is connected to the control device 22 via a pulse conductor 13*a*. The position of the leaflet transport device 11 or the tong-like holders 12 on the circulating path of the leaflet transport device 11 can be detected by the holder sensor 13.

The control device 22 may influence and adjust the drive device 19 of the delivery bands 17 and the folding apparatus 16 via a line 24. The control device 22 also communicates with the leaflet transport device 11 via line 30, drive device 34, and associated transfer element 36.

Figure 2:
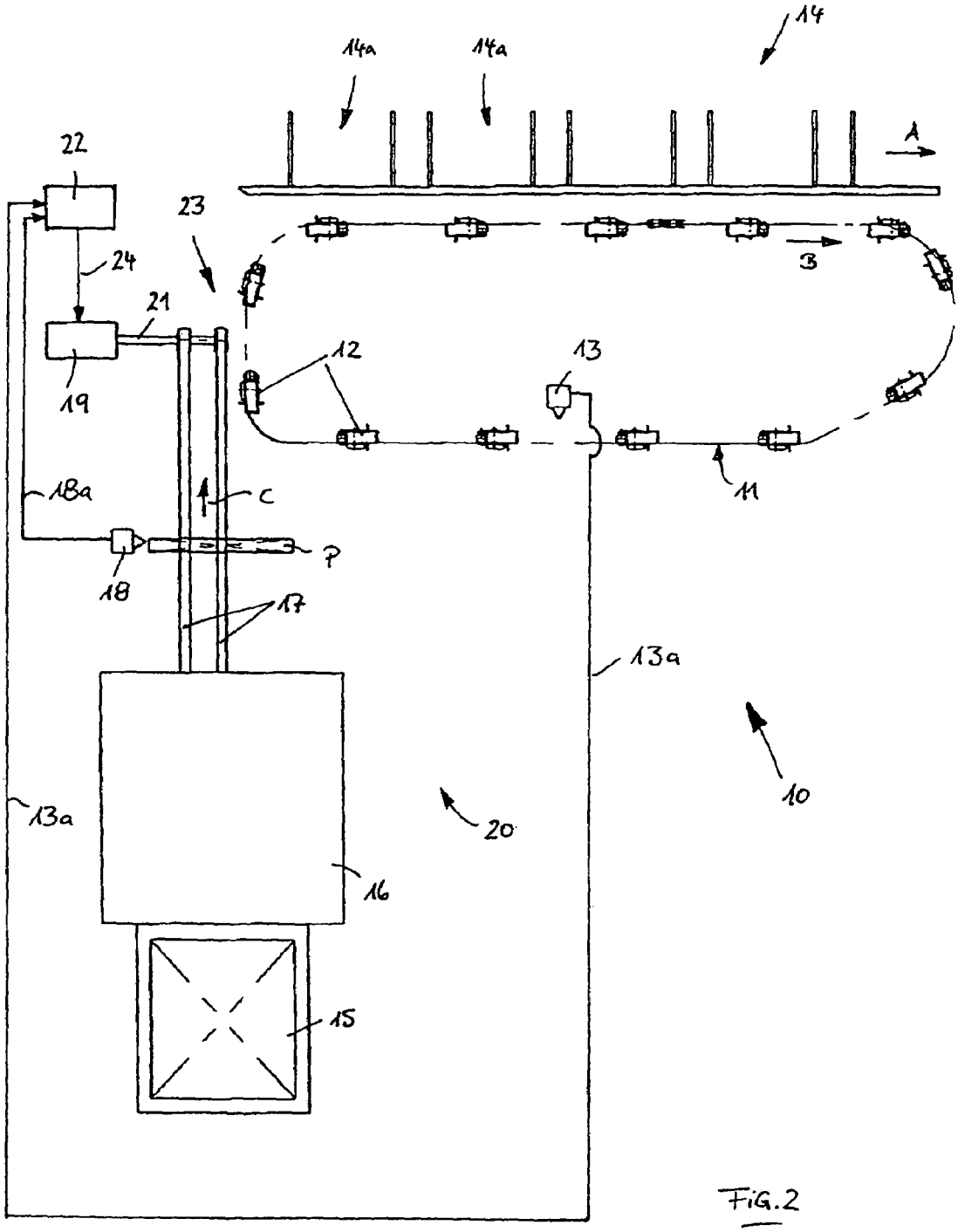
FIG. 2 shows the leaflet transfer device of FIG. 1 during detection of the actual relative position.
Figure 3:
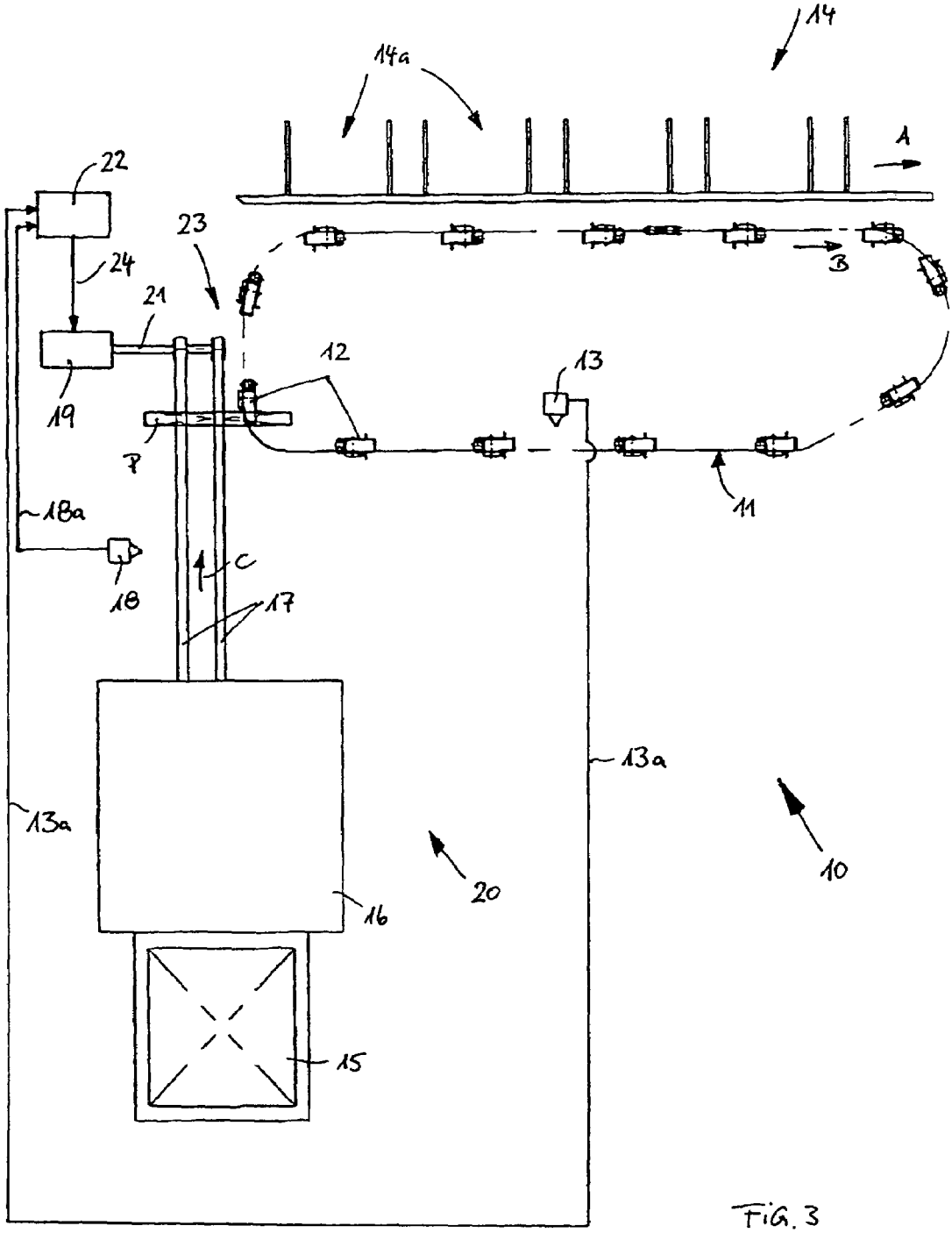
FIG. 3 shows a leaflet transfer device of FIG. 2 after matching the actual relative position with the desired relative position.
Figure 4:
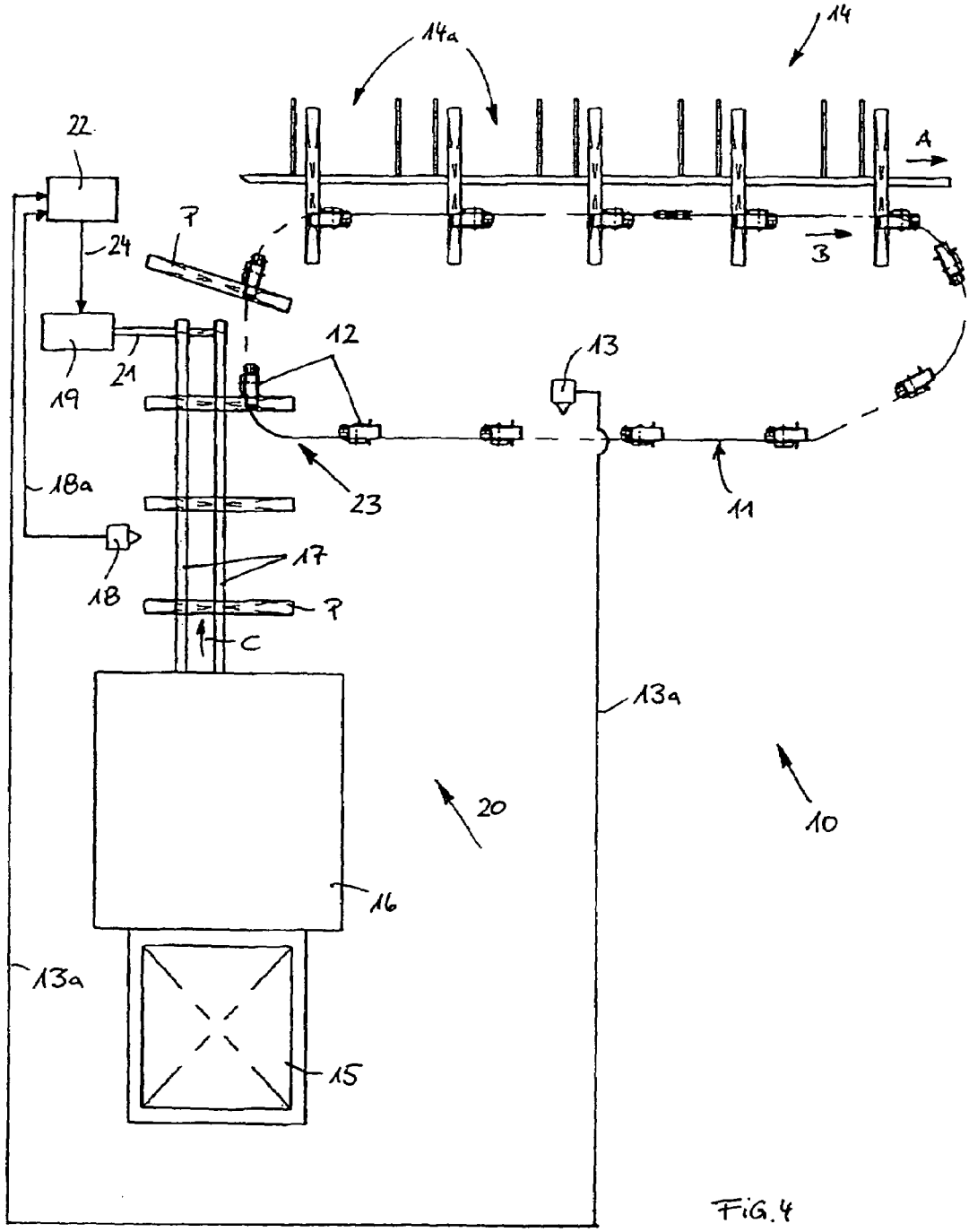
FIG. 4 shows the leaflet transfer device of FIG. 1 during operation of the packaging machine.

The procedure for format change is explained below:

When the packaging machine is to process leaflets of a different size, a calibration procedure is carried out, with which one leaflet P of the changed format is initially folded in the folding apparatus 16 and delivered via the delivery bands 17 in the direction of the transfer region 23. The leaflet transport device 11 is in a resting position which is detected by the holder sensor 13 and communicated to the control device 22 via the pulse conductor 13*a*. As soon as the leaflet P passes the leaflet sensor 18, a leaflet position signal is issued therefrom to the control device 22 via the pulse conductor 18*a* upon which it stops the drive device 19 of the delivery bands 17. The leaflet P is then directly adjacent to the leaflet sensor 18 (see FIG. 2). From the actual position of the leaflet transport device 11 or from its holders 12 and the actual position of the leaflet P on the delivery bands 17, the control device 22 calculates an actual relative position between the leaflet P and the holder 12 of the leaflet transport device 11 and compares it with a desired relative position. When the deviation between the actual relative position and the desired relative position is above a predetermined limit value, the deviation is compensated for in that the control device 22 activates the drive device 19 of the delivery bands 17 via the line 24 and adjusts the position of the leaflet P relative to the stationary leaflet transport device 11 (see FIG. 3). In this position, the leaflet P is exactly in its transfer position to an associated holder 12 of the leaflet transport device 11. The motion of the leaflet P in the leaflet supply device 20 and of the holders 12 in the leaflet transport device 11 are now synchronized, the calibration process is terminated, and the packaging machine can be permanently operated with both the leaflet supply device 20 and the leaflet transport device 11 moving at constant speed (see FIG. 4), based on the newly set relative or initial position.

Figure 5:
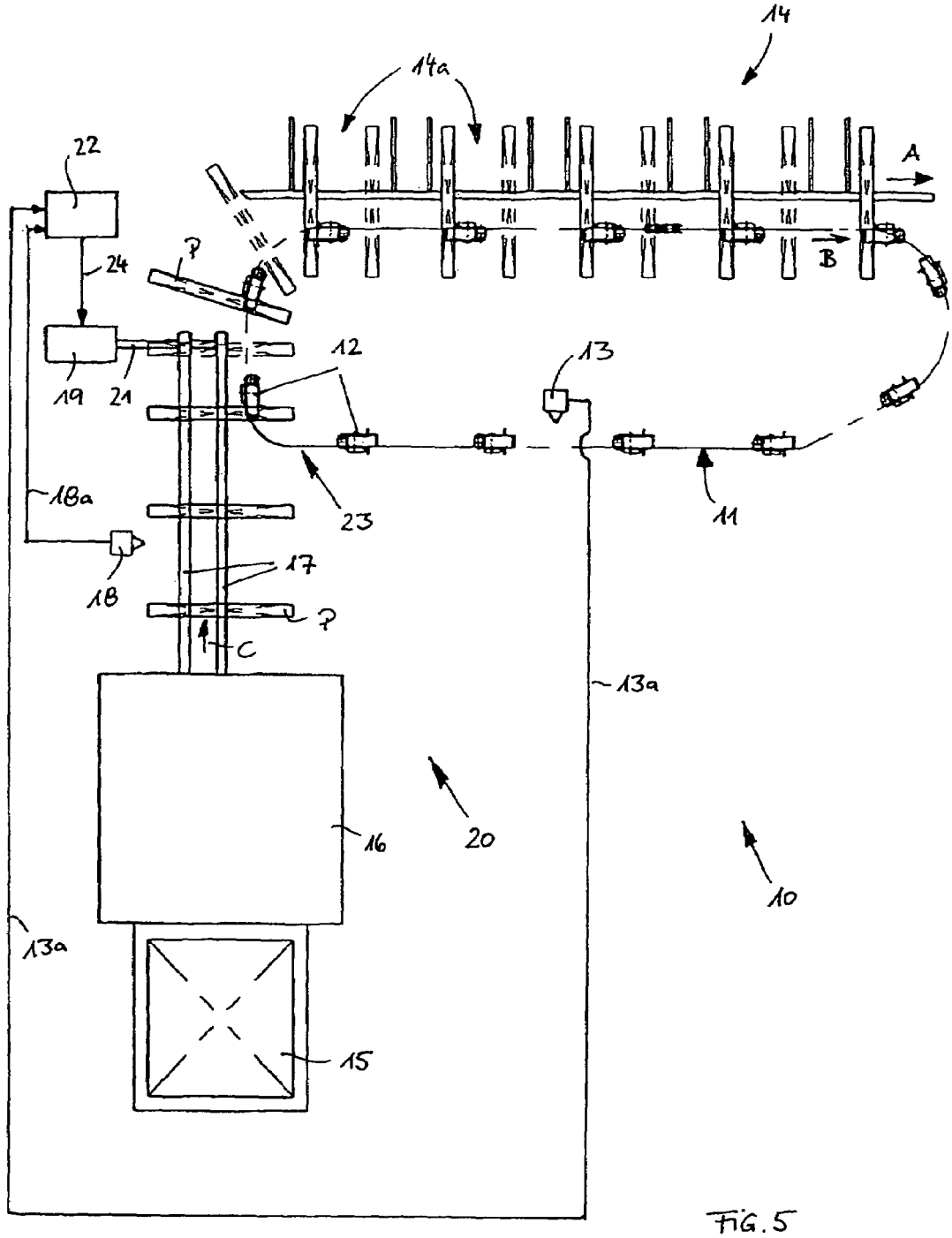
FIG. 5 shows the adjustment of the leaflet transport device relative to the folding box transport device.

For format change, adjustment of the leaflet transport device 11 relative to the folding box transport device 14 may be required. Towards this end, a user may release a coupling between the folding box transport device 14 and the leaflet transport device 11 which are both driven via the main drive. Alternatively, the folding box transport device 14 and the leaflet transport device 11 may each have their own drive. In either case, the leaflet transport device 11 may be adjusted in the peripheral direction thereby adjusting the leaflets P received in the holders 12 from the position shown with fully drawn lines in FIG. 5 to a position shown with dashed lines. The adjustment motion of the leaflet supply device 11 is detected and a corresponding signal is sent to the control device 22 which determines a correction signal and controls the drive device 19 of the delivery bands 17 of the leaflet supply device 20 in a corresponding manner to adjust the position of the leaflets P in the leaflet supply device 20. In this manner, the deviation between the holders 12 of the leaflet transport device 11 and the leaflets P of the leaflet supply device 20 which results from adjustment of the leaflet transport device 11 relative to the folding box transport device 14 can be compensated for with high accuracy.

We claim:

1. A method for changing a format in a packaging machine, the packaging machine having means for folding a leaflet in a folding apparatus, means for supplying the leaflet in a supply device at a constant speed $V_1$, means for receiving the leaflet at a transfer position in a holder disposed in a leaflet transport device, means for transporting the leaflet in said leaflet transport device, at a constant speed $V_2$, to a folding box transport device, and means for controlling motion of said supply device and said transport device independently of each other, the method comprising the steps of:

a) interrupting operation of the packaging machine;

b) detecting a first position of the leaflet in said leaflet supply device, using a first leaflet sensor;

c) transmitting said first position to a control device;

d) detecting a second position of said holder of said leaflet transport device using a holder sensor;

e) transmitting said second position to said control device;

f) determining, using said control device, an actual relative position between the leaflet and said holder and comparing said actual relative position to a desired relative position;

g) adjusting, using said control device, a deviation between said actual relative position and said desired relative position to be below a predetermined limit value;

h) setting a ratio $V_1/V_2$ to a constant value following step g); and i) resuming operation of the packaging machine following step h), keeping $V_1/V_2$ constant.

2. The method of claim 1, wherein an adjustment of said leaflet transport device relative to said folding box transport device is detected by said holder sensor, and a corresponding adjustment signal is transmitted to said control device in response to which said control device adjusts said first position of the leaflet in said leaflet supply device until said deviation between said actual relative position and said desired relative position is below said predetermined limit value.

3. The method of claim 1, wherein said control device adjusts said leaflet supply device.

4. The method of claim 1, wherein said control device adjusts said position of said holder in said leaflet transport device.

5. A device for changing a format in a packaging machine, the packaging machine having means for folding a leaflet in a folding apparatus, means for supplying the leaflet in a supply device at a constant speed $V_1$, means for receiving the leaflet at a transfer position in a holder disposed in a leaflet transport device, means for transporting the leaflet in said leaflet transport device, at a constant speed $V_2$, to a folding box transport device, and means for controlling motion of said supply device and said transport device independently of each other, the device comprising:

means for interrupting operation of the packaging machine;

means for detecting a first position of the leaflet in said leaflet supply device, using a first leaflet sensor;

means for transmitting said first position to a control device;

means for detecting a second position of said holder of said leaflet transport device using a holder sensor;

means for transmitting said second position to said control device;

means for determining, using said control device, an actual relative position between the leaflet and said holder and comparing said actual relative position to a desired relative position;

means for adjusting, using said control device, a deviation between said actual relative position and said desired relative position to be below a predetermined limit value;

means for setting a ratio $V_1/V_2$ to a constant value; and means for resuming operation of the packaging machine, keeping $V_1/V_2$ constant.

6. The leaflet transfer device of claim 5, wherein said leaflet supply device and said folding means have a common drive device.

7. The leaflet transfer device of claim 6, wherein said drive device comprises a servo motor.

8. The leaflet transfer device of claim 5, further comprising an adjustment device for adjusting said leaflet transport device relative to said folding box transport device, wherein adjustment of said leaflet transport device is detected by said holder sensor and a corresponding adjustment signal is transmitted to said control device.

9. The leaflet transfer device of claim 5, wherein said control device adjusts said leaflet supply device.

10. The leaflet transfer device of claim 5, wherein said control device adjusts a position of said holder in said leaflet transport device.

* * * * *